US007236727B2

(12) United States Patent
Fukuda

(10) Patent No.: US 7,236,727 B2
(45) Date of Patent: Jun. 26, 2007

(54) IMAGE FORMING APPARATUS

(75) Inventor: Tadashi Fukuda, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 136 days.

(21) Appl. No.: 11/107,735

(22) Filed: Apr. 18, 2005

(65) Prior Publication Data

US 2005/0238390 A1 Oct. 27, 2005

(30) Foreign Application Priority Data

Apr. 23, 2004 (JP) ..... 2004-128329

(51) Int. Cl.
*G03G 15/09* (2006.01)

(52) U.S. Cl. ..... 399/269; 399/267; 399/277

(58) Field of Classification Search ..... 399/267, 399/269, 277
See application file for complete search history.

(56) References Cited

U.S. PATENT DOCUMENTS 6,067,433 A 5/2000 Kimura et al. ..... 399/274
6,993,274 B2 * 1/2006 Hirobe ..... 399/269

FOREIGN PATENT DOCUMENTS

JP 11-194617 7/1999

* cited by examiner

*Primary Examiner*—David M. Gray
*Assistant Examiner*—Joseph S. Wong
(74) *Attorney, Agent, or Firm*—Fitzpatrick, Cella, Harper & Scinto

(57) ABSTRACT

An image forming apparatus includes an image bearing member for bearing and conveying an electrostatic image; a first developer carrying member for carrying and conveying a developer toward a first developing position; and a second developer carrying member for carrying and conveying the developer toward a second developing position, wherein when a time period required for a movement of the developer carried and conveyed by the first developer carrying member and the second developer carrying member from the first developing position through the developer delivering portion to the second developing position is assigned TA, and a time period required for a movement of the developer on the image bearing member from the first developing position to the second developing position is assigned TB, and wherein respective driving speeds of the image bearing member, the first developer carrying member, and the second developer carrying member are controlled so that TA and TB are different values.

4 Claims, 10 Drawing Sheets

PRIOR ART

PRIOR ART

PRIOR ART

IMAGE FORMING APPARATUS

BACKGROUND OF THE INVENTION

1. Field of the Invention

The present invention relates to an image forming apparatus such as a copying machine, a printer, a recorded image displaying device, or a facsimile for developing an electrostatic latent image formed on an image bearing member to form a visualized image using an electrophotographic system, an electroststatic recording system, or the like.

2. Related Background Art

Heretofore, an image forming apparatus such as a copying machine using an electrophotographic system or an electroststatic recording system is provided with a developing apparatus for visualizing an electrostatic latent image formed on an image bearing member such as a photosensitive drum by sticking developer to the electrostatic latent image, thereby forming a developer image (toner image). Developing systems for the developing operation carried out by the developing apparatus are roughly classified into a one-component developing system and a two-component developing system. In this case, a description will hereinafter be given with respect to a conventional example adopting the two-component developing system using a two-component developer containing toner and a carrier.

The basic construction of the developing apparatus includes a developer container for containing therein a developer, and an opening portion which is provided in a portion of the developer container opposed to an image bearing member. Also, a rotatable developer carrying member having irrotational magnetic field generating means built therein, e.g., a developing sleeve or a developing roller is installed in the opening portion with its peripheral surface being exposed. The developer carrying member bails out the developer contained in the developer container through a function of the internal magnetic field generating means, and feeds the developer up to a surface of an image bearing member through its rotational operation while the developer carrying member bears the developer. The developer is moved onto the surface of the image bearing member by applying a developing bias voltage to the image bearing member. In such a manner, a developing operation is carried out.

In a case of a conventional developing apparatus which is adapted to contain the two-component developer and which adopts such a basic construction, firstly, as a first example, a developing apparatus 102 is adopted in many cases, which has a construction as shown in FIG. 8 in which a first conveying screw 5 and a second conveying screw 6 as circulation means for conveying the two-component developer contained in a developer container 2 while agitating the two-component developer to cause the two-component developer to circulate within the developer container 2 are horizontally disposed.

In the developing apparatus 102, an opening portion is provided in a portion of the developer container 2 for containing therein a developer opposed to an image bearing member (not shown), and a developing sleeve 8 as a rotary member is provided in the opening portion. Then, a magnet roller 8*a* as magnetic field generating means is built in the developing sleeve 8 so as to be fixed against the rotation of the developing sleeve 8. Then, the first conveying screw 5 located nearer an image bearing member (not shown) of the two circulation means 5 and 6 provided as developer agitating members (conveying members) inside the developer container 2 is used to supply the developer to the developing sleeve 8 and to collect the developer which has passed through a developing portion as an opposing portion through which the developing sleeve 8 and the image bearing member are opposed to each other. In addition, the second conveying screw 6 is used to mix and agitate the developer collected from the developing sleeve 8 and a newly supplied developer with each other.

On the other hand, in recent years, in an image forming apparatus such as a copying machine or a printer using the electrophotographic system, in order to attain the space saving, a requirement for miniaturization of the apparatus main body has increased. In particular, in an image forming apparatus using a full-color system, a demand for miniaturization has been strong since a plurality of developing apparatuses are used.

In order to solve this problem, as a second construction obtained by improving the first construction shown in FIG. 8, a developing apparatus 103 having a construction shown in FIG. 9 as described in Japanese Patent Application Laid-open No. H05-333691 is designed. A feature of the developing apparatus 103 shown in FIG. 9 is such that in addition to the basic construction including the above developing sleeve 8, two conveying screws 5 and 6 as circulation means for a developer are vertically disposed on upper and lower sides, respectively.

More specifically, the developing apparatus 103 includes a developer container 2 which contains therein a developer, and a developing sleeve 8 as a developer carrying member which is provided in an opening portion of the developer container 2 opposed to a photosensitive drum 10. Then, a developing chamber 3 and an agitating chamber 4 which are separated through a partition wall 7 are vertically formed on a side opposite to that of the opening portion within the developer container 2. First and second conveying screws 5 and 6 as circulation means for agitating and conveying the developer to cause the developer to circulate within the developer container 2 are installed in the developing chamber 3 and the agitating chamber 4, respectively. The first conveying screw 5 feeds the developer contained in the developing chamber 3, and the second conveying screw 6 feeds toner which is supplied from a toner supply port (not shown) to an upstream side of the second conveying screw, and the developer which is already contained in the agitating chamber 4 while it agitates the toner and the developer within the agitating chamber 4, thereby unifying the toner density in the developer.

As described above, the vertical agitation type developing apparatus 103 shown in FIG. 9 has an advantage in that since the developing chamber 3 and the agitating chamber 4 are vertically disposed on the upper and lower sides, a horizontal occupancy space may be small. Thus, for example, even a color image forming apparatus using a tandem system or the like in which a plurality of developing apparatuses are horizontally installed in parallel with each other can be miniaturized. In addition, the supply of the developer to the developing sleeve 8 is carried out in the developing chamber 3 provided on the downstream side in a rotation direction of the developing sleeve 8, and the collection of the developer is carried out in the agitating chamber 4 provided on the upstream side. In such a manner, since the supply and collection of the developer to and from the developing sleeve 8 are carried out in the separate containing portions. As a result, the new developer is supplied in a state of being uniformly mixed with the collected developer to the developing sleeve 8. This can contribute to the high image quality promotion.

The miniaturization of the developing apparatus 103 has been realized by adopting the vertical agitation type. However, in recent years, the development for further promoting the high image quality and the long life has been advanced in addition to the miniaturization for the developing apparatus using the two-component developing system. In particular, first of all, in order to attain the long living of the developing apparatus using the two-component developing system, it is necessary to adopt a construction adapted to prevent the developer from being compressed and to prevent the toner degradation and the carrier degradation (carrier spent)

Referring now to FIG. 9 for example, a place where the developer is compressed within the developer container 2 is a portion in which a layer thickness of the developer attracted onto the developing sleeve 8 is regulated, i.e., a layer thickness regulating portion as a portion opposed to a blade-like regulating blade 9 for example which is provided in the opening portion of the developer container 2. Normally, with such a construction of the developing apparatus, a developer layer thickness regulating magnetic pole of a magnetic roller 8*a* for bearing the developer regulated by the regulating blade 9 on the developing sleeve 8 is located on an upstream side in the rotation direction of the developing sleeve 8 with respect to the regulating blade 9 in the vicinity of the regulating blade 9. Thus, the developer attracted onto the developing sleeve 8 by the developer layer thickness regulating magnetic pole is compressed between the developing sleeve 8 and the regulating blade 9 on the inner side of the developer container 2.

Then, in order to weaken the compression of the developer between the developing sleeve 8 and the regulating blade 9 on the inner side of the developer container 2, it is effective to weaken a force by which the developer thickness regulating magnetic pole in the magnetic roller 8*a* attracts the developer onto the developing sleeve 8, i.e., a force Fr vertically acting on the developing sleeve 8. In order to attain this, it is necessary to construct a magnetic pattern in which the magnetization of the carrier in the developer is reduced, i.e., a force for rubbing a toner image obtained on an image bearing member 10 in the developing portion through the development is weakened to realize the high image quality promotion, whereby the lines of magnetic force from the developer layer thickness regulating magnetic pole are hard to come into the adjacent poles and they come out in a radial direction of the developing sleeve 8 as much as possible.

As one method of reducing the magnetization of the carrier in the developer, while adopted as a third construction in the developing apparatus 103 as well shown in FIG. 9, a developing method is proposed in which a repulsive magnetic field is formed by repulsive magnetic poles of the magnet roller 8*a* within the developing sleeve 8 provided inside the developer container 2, and one of the repulsive magnetic poles is used as the developer layer thickness regulating magnetic pole (refer to Japanese Patent Application No. H09-316478).

When the magnetic poles having the same polarity are located side by side to form the repulsive magnetic field in accordance with this method, the lines of magnetic force from the respective magnetic poles come out vertically to the surface of the developing sleeve 8. In this case, a rate of change in magnetic flux density vertical to the surface of the developing sleeve 8 is small. As a result, the force for attracting the developer onto the developing sleeve 8 is reduced, and the degree of compression of the developer is reduced accordingly.

However, when the construction of the conventional developing apparatus using the two-component developing system, i.e., the construction is adopted in which one magnetic pole of the repulsive magnetic poles is used as the developer layer thickness regulating magnetic pole, there is a possibility that screw pitch-like density unevenness is generated in a trailing end portion of a recording material in which a solid image, especially, a black solid image is formed in a conveying direction.

A mixture ratio between the developer which has the reduced density of the toner (having the image history) and which is moved to the developer layer thickness regulating magnetic pole after being peeled off by the repulsive magnetic field and the developer supplied to the developer layer thickness regulating magnetic pole portion of the developing sleeve after being agitated and conveyed by the conveying screw changes with a rotation period of the conveying screw in a longitudinal direction of an image area, thereby generating that phenomenon.

In addition, that phenomenon is apt to generate when an agent surface of the developer in the vicinity of the developing sleeve is relatively low and the conveying screw is disposed in the vicinity of the developer layer thickness regulating magnetic poles. Moreover, the above phenomenon is also apt to generate when the magnitude of the magnetization of the magnetic carrier is reduced. This reason is that when the magnetization of the carrier is small, the developer becomes magnetically insensitive to the magnetic field and the developer after completion of the development is readily moved to the developer layer thickness regulating magnetic pole without being peeled off by the peeling-off magnetic poles.

Then, in addition to the basic construction, the vertical agitation type construction as the second construction, and the construction as the third construction in which the repulsive magnetic poles including the layer thickness regulating magnetic pole are provided in the magnetic field generating means built in the developer carrying member in the developer container, a developing apparatus having a plurality of developer carrying members disposed therein was designated as a developing apparatus having a fourth construction. In a developing apparatus 101 shown as an example thereof in FIG. 10, there are disposed two developing sleeves, i.e., a developing sleeve 8 opposed to a photosensitive drum 10 on an upstream side in the rotation direction of the drum and a developing sleeve 11 opposed to the photosensitive drum 10 on a downstream side in the rotation direction of the drum. The developing sleeves 8 and 11 constitute a first developing portion X1 and a second developing portion X2 in the portions opposed to the photosensitive drum 10, respectively. In the developing apparatus 101, the screw pitch-like density unevenness can also be made inconspicuous. This effect is offered based on a function in which even when the screw pitch-like density unevenness is generated in the developing sleeve 8 on the upstream side, the screw pitch-like density unevenness is reduced through the development by the developing sleeve 11 disposed on the downstream side.

However, even when the developing apparatus has a plurality of developing sleeves, the screw pitch-like density unevenness cannot be perfectly erased.

Under the circumstances in which in recent years, there has been required the performance capable of coping with graphic images, such as a presentation document having high image duty, other than characters and graphs, there is a demand of preventing the screw pitch-like density unevenness from being generated.

SUMMARY OF THE INVENTION

It is an object of the present invention to provide an image forming apparatus which is capable of effectively preventing generation of density unevenness in a first developer carrying member due to a history during development.

To achieve the above object, according to the present invention, there is provided an image forming apparatus, including:

an image bearing member for bearing and conveying an electrostatic image;

a first developer carrying member for carrying and conveying a developer toward a first developing position; and a second developer carrying member for carrying and conveying the developer toward a second developing position, the second developing position is disposed at a downstream side with respect to the first developing position in a movement direction of the image bearing member, wherein the second developer carrying member is constructed so that the developer carried and conveyed by the first developer carrying member is delivered to the second developer carrying member, and wherein when a time period required for a movement of the developer carried and conveyed by the first developer carrying member and the second developer carrying member from the first developing position through the developer delivering portion to the second developing position is assigned TA, and a time period required for a movement of the developer on the image bearing member from the first developing position to the second developing position is assigned TB, and wherein respective driving speeds of the image bearing member, the first developer carrying member, and the second developer carrying member are controlled so that TA and TB are different values.

DESCRIPTION OF THE PREFERRED EMBODIMENTS

A developing apparatus and an image forming apparatus according to the present invention will hereinafter be described in more detail with reference to the accompanying drawings.

Embodiment 1

Firstly, a description will now be given with respect to a construction of an image forming apparatus in which a developing apparatus to which the present invention is applied is installed. While as a construction of the image forming apparatus, for example, an image forming apparatus having a construction as will be described below is given as an example, the construction of the image forming apparatus is not necessarily limited to this aspect.

Figure 1:
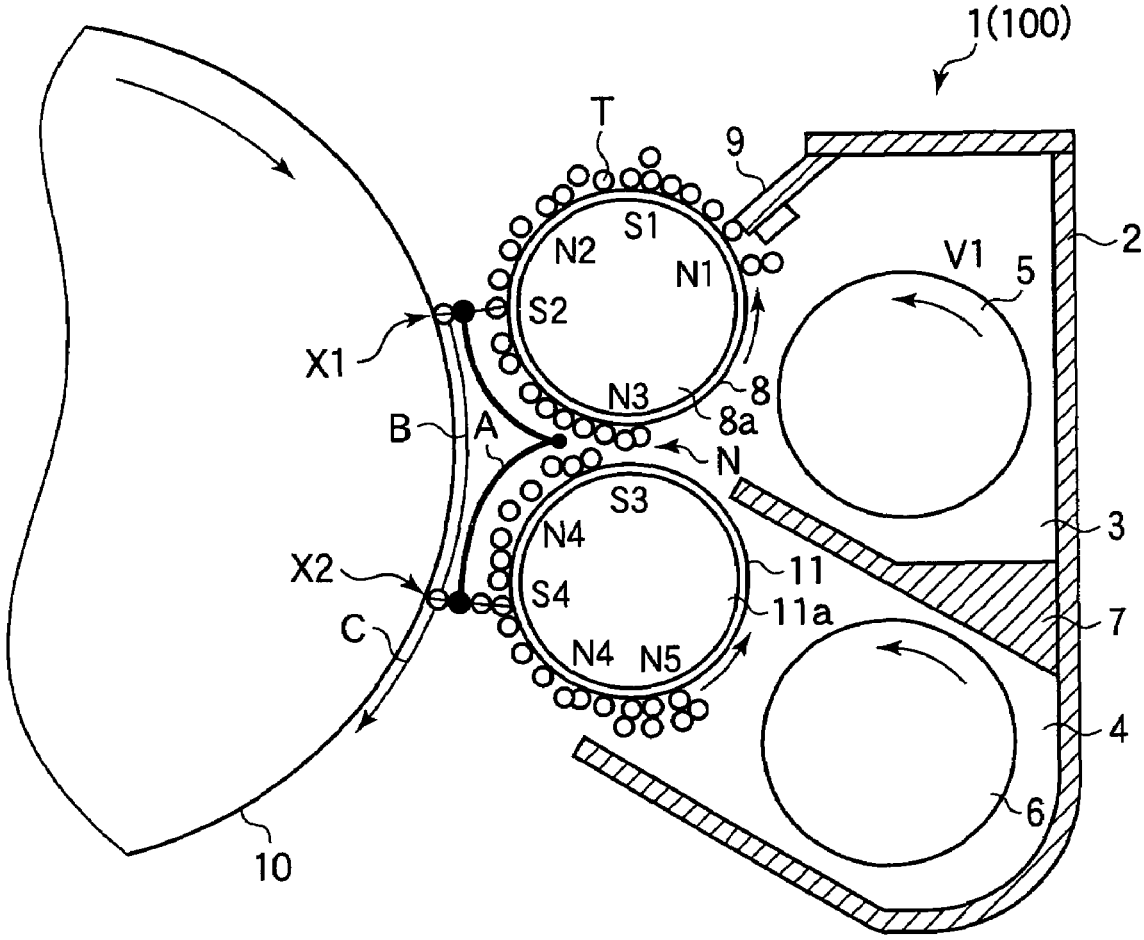
FIG. 1 is a cross-sectional view showing a developing apparatus according to Embodiment 1 of the present invention.
Figure 4:
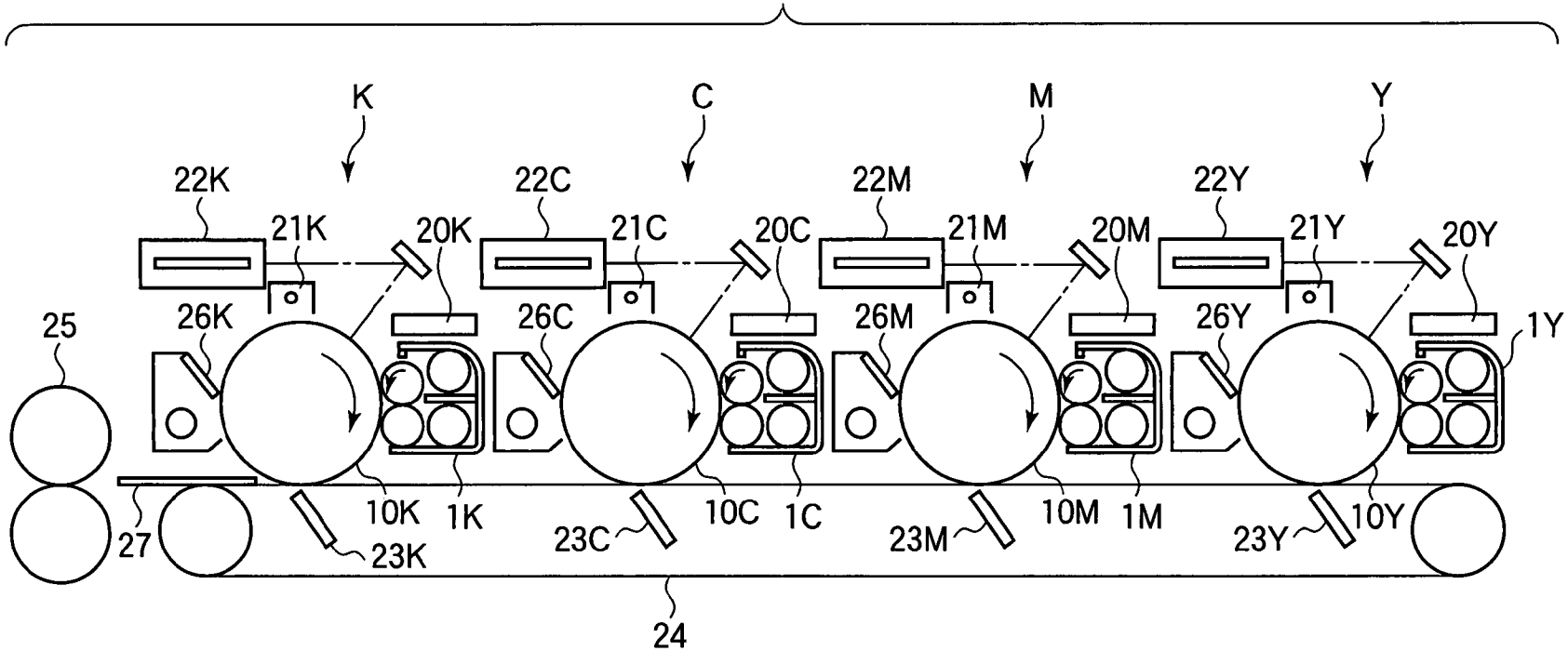
FIG. 4 is a schematic view showing a construction of an image forming apparatus according to Embodiment 1 of the present invention.

FIG. 1 shows a positional relationship between an image bearing member (photosensitive drum) 10 in each of image forming portions (stations) Y, M, C, and K and a developing apparatus 1 in a full-color image forming apparatus as shown in FIG. 4. The stations Y, M, C, and K have nearly the same construction and form images of Yellow (Y), Magenta (M), Cyan (C), and Black (K) in a color image, respectively. In the following description, when for example, the developing apparatus is written as a developing apparatus 1, it is supposed that a developing apparatus 1Y, a developing apparatus 1M, a developing apparatus 1C, and a developing apparatus 1K in the respective stations Y, M, C, and K are commonly designated.

An operation of the overall image forming apparatus will hereinafter be described with reference to FIG. 4. The stations Y, M, C, and K are disposed in a line along a recording material conveyance direction. Developer images which are formed in the respective stations and which are different in color from one another are transferred onto the recording material on top of one another through a process of conveyance of the recording material.

Each station is constituted by an image bearing member and image forming means acting on the image bearing member. In each station, the photosensitive drum 10 as the image bearing member is rotatably provided. The photosensitive drum 10 is charged uniformly with electricity by a primary charger 21 as charging means as one of the image forming means, and is then exposed with light such as a laser which is radiated by a light emitting element 22 as latent image forming means and which is modulated in accordance with an information signal to form a latent image on its surface. The resultant latent image is visualized in the form of a developer image (toner image) through a process as will be described later by the developing apparatus 1 as developing means. The resultant toner image is transferred onto a transferring sheet 27 as the recording material conveyed by a recording material conveyer sheet 24 every station by a first transfer charger 23 as transferring means, and is then fixed by a fixing apparatus 25 to obtain a permanent image.

In addition, the transfer residual toner left on the surface of the photosensitive drum 10 is removed by a cleaning apparatus 26 which is disposed as cleaning means in each station. Also, new toner is supplied from a toner supply vessel 20 provided in correspondence to the associated one of the developing apparatuses 1 in order to compensate for the toner in the developer consumed through the image formation process.

In addition, in this case, the method is adopted in which the toner images are directly transferred from the photosensitive drums 10M, 10C, 10Y, and 10K onto the transferring sheet 27 as a recording material conveyed by the recording material conveyer sheet 24. However, the present invention can also be applied to an image forming apparatus in which an intermediate transferring member is provided instead of the transferring material conveyer sheet 24, and after the toner images having the respective colors are primarily transferred from the photosensitive drums 10M, 10C, 10Y, and 10K corresponding to the respective colors onto the intermediate transferring member, the composite toner images having the respective colors are collectively secondarily transferred onto the transferring sheet.

Next, an operation of the developing apparatus 1 to which the present invention is applied will be described with reference to FIG. 1. The developing apparatus 1 of Embodiment 1 includes a first developing sleeve 8 as a first developer carrying member and a regulating blade 9 as a developer regulating member which is installed so as to face the developing sleeve 8 and which serves to regulate a layer thickness of the developer borne on the surface of the developing sleeve 8 within a developer container 2 containing a two-component developer containing nonmagnetic toner and a magnetic carrier. An opening portion is provided in a position of the developer container 2 corresponding to developing portions opposed to the photosensitive drum 10. The developing sleeves 8 and 11 are rotatably disposed in the opening portion so that their parts are exposed to the photosensitive drum 10 side. Then, the developing sleeves 8 and 11 include therein magnets 8*a* and 11*a* as irrotational and cylindrical magnetic field generating means having the magnetic poles installed therein as will be described in detail later, respectively. The developing sleeves 8 and 11 draw up the developer from the developer container 2 based on the operations of the magnets 8*a* and 11*a* and feed the developer to the developing portions through their rotations. Here, the developing portion corresponding to the developing sleeve 8 disposed on the upstream side in the rotation direction of the photosensitive drum 1 (hereinafter referred to as "the upstream developing sleeve") is assigned a first developing portion X1, and the developing portion corresponding to the developing sleeve 11 disposed on the downstream side in the rotation direction of the photosensitive drum 1 (hereinafter referred to as "the downstream developing sleeve") is assigned a second developing portion X2. That is, the developing apparatus 1 of Embodiment 1 has the conventional basic construction and the fourth construction which is defined as the construction having a plurality of developing sleeves.

In addition, the developing apparatus 1 of Embodiment 1 also has the conventional second construction. In other words, the developing apparatus 1 of Embodiment 1 adopts the vertical agitation type construction. Thus, the developer container 2 is partitioned into upper and lower sides, i.e., a developing chamber 3 and an agitating chamber 4 through a partition wall 7 which extends vertically to a paper surface nearly in a central portion of the developer container 2. The developer is contained in the developing chamber 3 and the agitating chamber 4. First and second conveying screws 5 and 6 as circulation means for agitating and conveying the developer T to cause the developer T to circulate within the developer container 2 are disposed in the developing chamber 3 and the agitating chamber 4, respectively.

Figure 5:
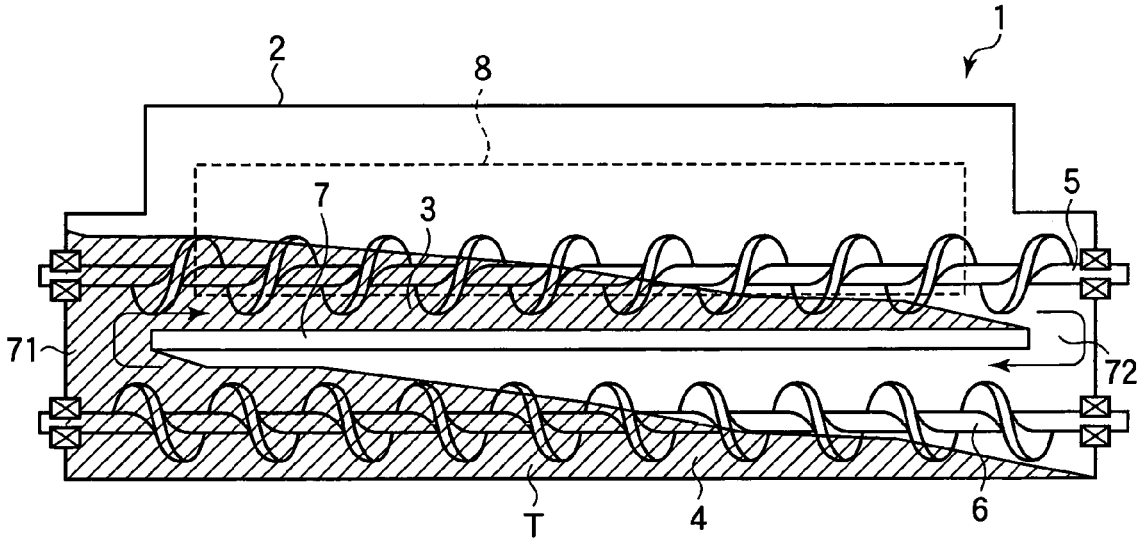
FIG. 5 is a longitudinal cross-sectional view showing the developing apparatus according to Embodiment 1 of the present invention.

That is, as clearly understood when reference is made to a transverse cross sectional view of shaft portions of the first and second conveying screws 5 and 6 of the developer container 2 shown in FIG. 5, the first conveying screw 5 is disposed nearly in parallel with the developing sleeve 8 along an axial direction of the developing sleeve 8 in a bottom portion of the developing chamber 3 and rotates to feed the developer T held within the developing chamber 3 in one direction along the axial direction. In addition, the second conveying screw 6 is disposed nearly in parallel with the first conveying screw 5 in a bottom portion of the agitating chamber 4 and rotates to feed the developer T within the agitating chamber 4 in a direction opposite to that in the first conveying screw 5.

In such a manner, the developer T is conveyed through the rotation of the first and second conveying screws 5 and 6 to be caused to circulate between the developing chamber 3 and the agitating chamber 4 through communication portions 71 and 72 as opening portions in mutually opposite end portions of the partition wall 7.

Moreover, the developing apparatus 1 of Embodiment 1 has the third construction in which the magnet 8*a* within the developing sleeve 8 has the repulsive magnetic poles within the developer container 2. That is, the developing sleeve 8 is made of a nonmagnetic material. As described above, a magnet roller 8*a* as first magnetic field generating means is installed in an irrotational state inside the developing sleeve 8. The magnet roller 8*a* has a developing magnetic pole S2, and magnetic poles S1, N1, N2, and N3 for conveying the developer T. Of those magnetic poles S1, S2, N1, N2, and N3, the first magnetic pole N3 and the second magnetic pole N1 having the same polarity are installed side by side on the inner side of the developer container 2. Thus, a repulsive magnetic field is formed between the first and second magnetic poles N3 and N1, and hence a barrier is formed against the developer T so that the developer T is separated in the agitating chamber 4. Then, the downstream side second magnetic pole N1 of those repulsive magnetic poles becomes the developer layer thickness regulating magnetic pole.

Figure 6:
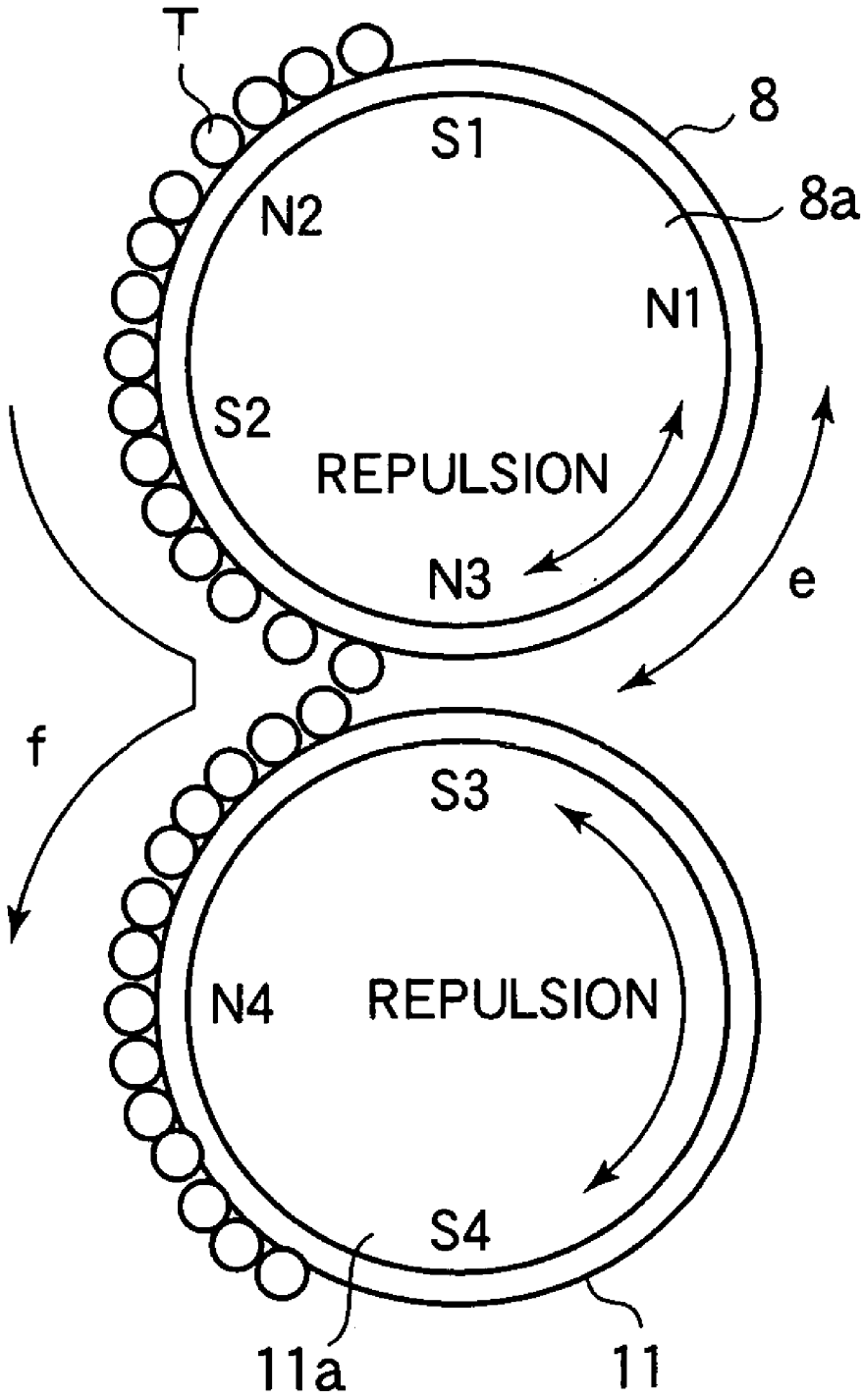
FIG. 6 is a cross-sectional view showing upstream and downstream developer carrying members according to Embodiment 1 of the present invention.

A more concrete flow of the developer T will hereinafter be descried with reference to FIG. 6 as an enlarged view of the vicinity of the upstream developing sleeve 8 and the downstream developing sleeve 11. As described above, the repulsive magnetic field is formed between the first magnetic pole N3 and the second magnetic pole N1 within the upstream developing sleeve 8. A repulsive magnetic field is also formed between the third magnetic pole S3 and the fourth magnetic pole S4 within the downstream developing sleeve 11. Then, the first magnetic pole N3 within the upstream developing sleeve 8 and the third magnetic pole S3 within the downstream developing sleeve 11 are close to each other in an opposing portion between the upstream and downstream developing sleeves 8 and 11. Note that the repulsive magnetic field formed between the first and second magnetic poles N3 and N1 within the upstream developing sleeve 8, and the repulsive magnetic field formed between the third and fourth magnetic poles S3 and S4 within the downstream developing sleeve 11 are directed to the same side, i.e., directed to the inner side direction of the developer container 2.

Thus, though the developer T which has been conveyed onto the upstream developing sleeve 8 to pass through the first developing portion reaches the position of the first magnetic pole N3 of the magnet 8*a*, almost the developer T cannot slip through the closest portion as the opposing portion between the upstream and downstream developing sleeves 8 and 11 to pass therethrough as indicated by an arrow "e" because of the formation of the repulsive magnetic field between the upstream side first magnetic pole N3 and the downstream side second magnetic pole N1 of the magnet 8*a*.

The great part of the developer T cannot follow the rotational movement of the upstream developing sleeve 8 and hence is moved to the downstream developing sleeve 11 side in accordance with a line of magnetic force extending from the first magnetic pole N3 of the magnet 8*a* on the upstream developing sleeve 8 side to the third magnetic pole S3 of the magnet 11*a* on the downstream developing sleeve 11 side as indicated by an arrow "f" to be conveyed to the second conveying screw 6 within the agitating chamber 4 through the downstream developing sleeve 11. This cycle is repeatedly carried out.

As a matter of course, since the developing apparatus of Embodiment 1 has the first to fourth constructions described in Related Background Art, the developing efficiency can be enhanced and an image more faithful to the latent image can be developed as compared with the developing device having the single developing sleeve shown in the conventional examples.

In such a developing apparatus 1, as described in the conventional examples, even in the case of the construction having a plurality of developing sleeves, when the construction is adopted in which one magnetic pole of the repulsive magnetic poles is used as the developer layer thickness regulating magnetic pole, there is a possibility that the screw pitch-like density unevenness is generated in the trailing end portion of the recording material having the solid image in the conveyance direction.

In this phenomenon, as described in the conventional examples as well, the developer which has the reduced density of the toner having the image history and which is moved to the developer layer thickness regulating magnetic pole after having been peeled off by the repulsive magnetic field is immediately conveyed to the upstream developing sleeve 8 by the first conveying screw 5. The developer having the irregular toner density unevenness following the screw pitch is then conveyed and supplied to the downstream developing sleeve 11. The irregular toner density unevenness following the screw pitch is generated in the longitudinal direction of the image area while it changes with the rotational period of the first conveying screw 5. Though the measures have been taken to make the screw pitch-like density unevenness inconspicuous by adopting the fourth construction having a plurality of developing sleeves, even in this case, the screw pitch-like unevenness cannot be perfectly prevented from being generated in the solid image.

A description will hereinafter be given with respect to the screw pitch-like density unevenness in the solid image when a plurality of developing sleeves 8 and 11 are made close to the photosensitive drum 10 to be made contribute to the development as in Embodiment 1.

Figure 7A:
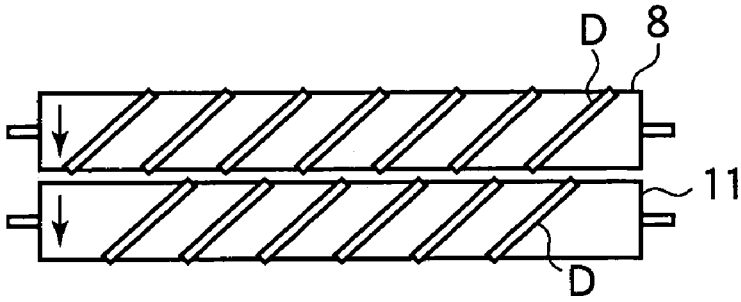
FIGS. 7A and 7B are explanatory views showing transference of the screw pitch-like density unevenness from the developer carrying members to the image bearing member.
Figure 7B:
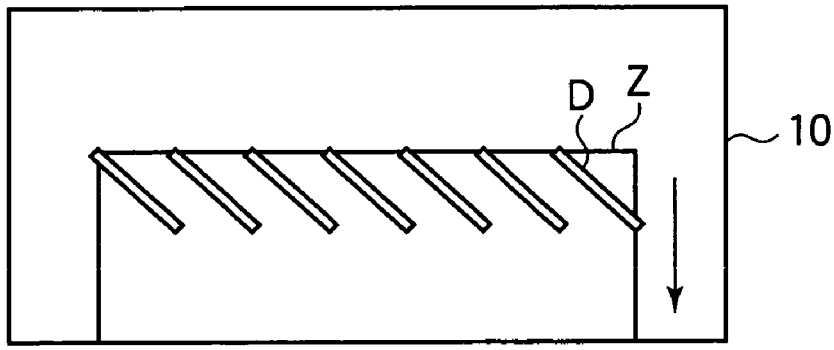

The developer T which is unstable in mixture ratio reaches the developer layer thickness regulating magnetic pole N1 and is then supplied in a state of having the screw pitch-like density unevenness D to the upstream developing sleeve 8 on the upstream side in the rotation direction of the photosensitive drum 10. Then, the developer T on the upper and lower sides of the upstream developing sleeve 8 is moved to the downstream developing sleeve 11 in accordance with the line of magnetic force indicated by the arrow "f" shown in FIG. 6. While a phase of the screw pitch-like density unevenness D changes as shown in FIG. 7A, the developer T is conveyed in a state of having the screw pitch-like density unevenness D to the downstream developing sleeve 11 as well. For this reason, as shown in FIG. 7B, the screw pitch-like density unevenness D appears on an image Z on the photosensitive drum 10.

In particular, when solid images each having high duty are continuously copied, the toner is abruptly consumed. Hence, the density of the toner contained in the developer container 2 is apt to become heterogeneous thus becomes unstable. As a result, the screw pitch-like density unevenness D becomes apt to generate.

In addition, a little amount of developer which is subjected to the development in the upstream developing sleeve 8 to be reduced in its toner density follows the rotational movement of the upstream developing sleeve 8 in the teeth of the delivery magnetic field and the repulsive magnetic field between the upstream developing sleeve 8 and the downstream developing sleeve 11. Then, the developer is supplied in a state of having the screw pitch-like toner density unevenness D to the Upstream developing sleeve 8 in some cases.

In any case, the image having the screw pitch-like toner density unevenness D in the upstream developing sleeve 8 is developed on the photosensitive drum 10 and moreover the developer T is also conveyed in a state of having the screw pitch-like density unevenness D to the downstream developing sleeve 11.

Here, the image which is actually formed on the recording material P is an image after having passed through the second developing portion X2 on the surface of the photosensitive drum 10, i.e., an image which is formed in an area C between the second developing portion X2 and the transferring portion 23 in FIG. 1. Then, in the second developing portion X2, the developer borne on the downstream developing sleeve 11 is developed on the image formed in the first developing portion X1. That is, the solid image is an image which is formed through reception of an influence by the developing operation for the developer (in this case, the developer layer because of the solid image) on the image formed in an area B between the first developing portion X1 and the second developing portion X2 of the photosensitive drum 10, and the developer layer which is obtained by bearing the developer layer not developed in the first developing portion X1 in the downstream developing sleeve 11 through the opposing portion between the upstream and downstream developing sleeves 8 and 11, i.e., the developer layer formed in a path A shown in FIG. 1 as the path indicated by the arrow "f" in FIG. 6.

At this time, it is possible to measure a cross-sectional profile of the density which is obtained by detecting a bearing amount of toner of the developer layer on the photosensitive drum 10 and the upstream developing sleeve 8 in the above path A and the areas B and C in FIG. 1 using an optical sensor or the like. A situation in which the screw pitch-like density unevenness D is generated will hereinafter be described with reference to FIGS. 2A, 2B, and 2C, and FIGS. 3A, 3B, and 3C showing schematic cross-sectional profiles each of which is obtained through such measurement.

Figure 3A:
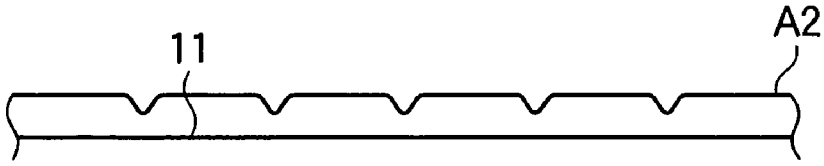
FIG. 3A is a view showing a cross-sectional profile of a developer layer on a surface of a developer carrying member after the developer has passed through a first developing portion when screw pitch-like density unevenness is generated.
Figure 3B:
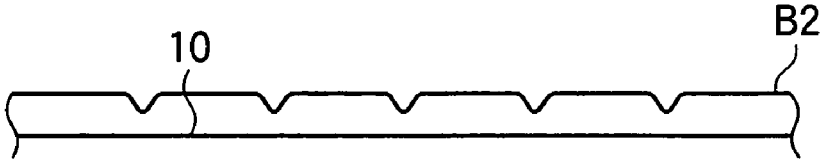
FIG. 3B is a view showing a cross-sectional profile of the developer layer on a surface of an image bearing member after the developer has passed through the first developing portion when the screw pitch-like density unevenness is generated.
Figure 3C:
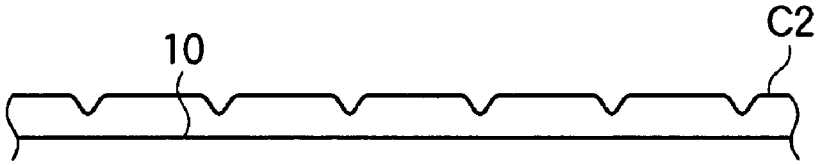
FIG. 3C is a view showing a cross-sectional profile of the developer layer on the surface of the image bearing member after the developer has passed through a second developing portion when the screw pitch-like density unevenness is generated.

FIGS. 3A, 3B, and 3C show the cross-sectional profiles of the developer layers in the above path A, and the above areas B and C, respectively, when the screw pitch-like density unevenness D is generated.

Firstly, when a bearing amount of toner is measured in the form of a cross-sectional view of the screw pitch-like density unevenness D in the developer layer in the area B portion, i.e., the screw pitch-like density unevenness D formed in the upstream developing sleeve 8 in the axial direction of the photosensitive drum 10, an amount of toner in a portion having low density is measured as being low. Thus, as shown in FIG. 3B, a portion in which a bearing amount of toner is less is generated nearly at equal intervals in cross section. In addition, the developer T is conveyed to the second developing portion X2 of the downstream developing sleeve 11 so as to follow the path A while there is held the same screw pitch-like density unevenness D (unevenness in a bearing amount of toner) formed in the upstream developing sleeve 8 to show the same state as that of the toner state (FIG. 3B) on the photosensitive drum 10 provided by the upstream developing sleeve 8 as shown in FIG. 3A.

At this time, in the second developing portion X2 of the downstream developing sleeve 11, a profile A2 of the developer which is conveyed from the upstream developing sleeve 8 so as to follow the path A shown in FIG. 3A, and a profile B2 of the developer T on the photosensitive drum 10 in the area B after the developer T has passed through the first developing portion X1 shown in FIG. 3B are superposed in phase on each other. Thus, in the area after the surface of the photosensitive drum 10 has passed through the second developing portion X2, i.e., in the area C, the toner image on the surface of the photosensitive drum 10 is developed so as to show such a state as a profile C2 shown in FIG. 3C.

In other words, a portion having a less bearing amount of toner in the profile A2 of the toner developed on the photosensitive drum 10 by the upstream developing sleeve 8, and a portion having a less bearing amount of toner in the profile B2 of the toner moved from the upstream developing sleeve 8 to the downstream developing sleeve 11 through the opposing portion between the upstream developing sleeve 8 and the downstream developing sleeve 11 may be superposed on each other since the screw pitch-like density unevenness D is generated at the same intervals between the developer layers having the profiles A2 and B2, respectively, and thus while the screw pitch-like density unevenness D generated by the upstream developing sleeve 8 is made slightly negligible by the downstream developing sleeve 11, the screw pitch-like density unevenness D cannot be perfectly erased. Thus, even when a plurality of developing sleeves are disposed in order to realize the high image quality promotion, the best use of its performance is not made up.

Then, peripheral speeds of the upstream and downstream developing sleeves 8 and 11, a peripheral speed of the photosensitive drum 10, an angular velocity of the first conveying screw 5 for supplying the developer T to the upstream developing sleeve 8, and the like were adjusted, whereby concave portions in the screw pitch-like density heterogeneities in both the developer layer of the developer which was directly moved from the upstream developing sleeve 8 to the downstream developing sleeve 11 so as to follow the path A, and the toner layer on the area B of the photosensitive drum 10 which was developed by the upstream developing sleeve 8 were prevented from being superposed on each other in the second developing portion X2.

Figure 2A:
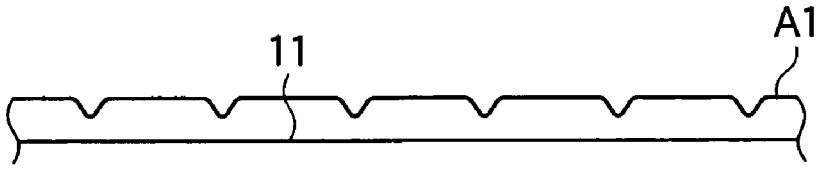
FIG. 2A is a view showing a cross-sectional profile of a developer layer on a surface of a developer carrying member after the developer has passed through a first developing portion when screw pitch-like density unevenness can be prevented.
Figure 2B:
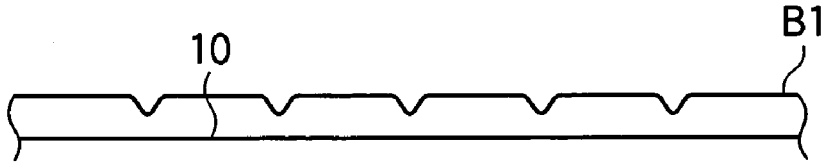
FIG. 2B is a view showing a cross-sectional profile of the developer layer on the surface of the image bearing member after the developer has passed through a first developing portion when the screw pitch-like density unevenness can be prevented.
Figure 2C:
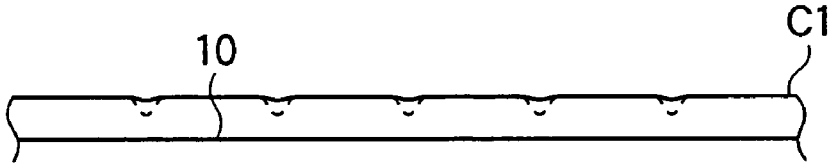
FIG. 2C is a view showing a cross-sectional profile of the developer layer on the surface of the image bearing member after the developer has passed through a second developing portion when the screw pitch-like density unevenness can be prevented.

Similarly to FIGS. 3A, 3B, and 3C, FIGS. 2A, 2B, and 2C show cross-sectional profiles of bearing amounts of toner in the axial direction of the photosensitive drum 10 at this time. A profile A1 of the developer which was directly moved from the upstream developing sleeve 8 to the downstream developing sleeve 11 at this time so as to follow the path A was the same as the above profile A2 obtained through the same process. However, in a state of the toner image provided by the upstream developing sleeve 8 after the developer had passed through the first developing portion X1, i.e., in the area B, in a cross-sectional profile B1 of a bearing amount of toner in the downstream developing sleeve 11 as shown in FIG. 2B, concave portions were generated in positions which were not superposed on the concave portions in the profile A1. Thus, even when both the developer having the profile A2 and the developer having the profile B1 were superposed on each other, the concave portions of the developer having the profile A1 and the concave portions of the developer having the profile B1 were not superposed on each other. Thus, though the cross-sectional profile B1 when the development was carried out using the upstream developing sleeve 8 had the screw pitch-like density unevenness D, as in a profile C1 in the area C shown in FIG. 2C, the toner was supplied to the concave portions through the development by the downstream developing sleeve 11, thereby allowing the screw pitch-like density unevenness D to be greatly reduced. Even when the screw pitch-like density unevenness D on paper was actually measured, Δ0.025 was obtained as reflection density and thus it could be verified that in-plane density uniformity was greatly improved.

From the foregoing, it was found out that the final level of the screw pitch-like density unevenness D is determined based on the superposition of the phase in the case where the screw pitch-like density unevenness D generated on the photosensitive drum 10 when the development is carried out by the upstream developing sleeve 8 is conveyed to the downstream developing sleeve 11, and the phase of the screw pitch-like density unevenness D on the downstream developing sleeve 11.

From the above description, the feature of Embodiment 1 is such that the conditions are determined so as to prevent the concave portions of the screw pitch-like density unevenness D in the toner image formed in the first developing portion X1, and the concave portions of the screw pitch-like density unevenness D in the toner image obtained through the development by the downstream developing sleeve 11 from being superposed on each other in the second developing portion X2.

In Embodiment 1, the dark and light portions in phase of the screw pitch-like density unevenness D on the downstream developing sleeve 11 side and the dark and light portions in phase of the screw pitch-like density unevenness D on the photosensitive drum 10 having the toner obtained through the development by the upstream developing sleeve 8 are prevented from being superposed on each other by satisfying the following conditions.

Firstly, when an angular velocity of the first conveying screw 5 for agitating and supplying the developer T to the upstream developing sleeve 8 is assigned V1, the screw pitch-like density unevenness D generated on the upstream developing sleeve 8 is formed at intervals of 2π/V1. Next, a time period required to feed the developer T from the first developing portion X1 of the upstream developing sleeve 8 to the second developing portion X2 of the downstream developing sleeve 11 through the delivery and bearing of the developer T from the upstream developing sleeve 8 to the downstream developing sleeve 11 by the respective rotational movements, i.e., a time period required for movement of the developer T through the path A shown in FIG. 1 is assigned TA, and a time period required to feed the developer T from the first developing portion X1 to the second developing portion X2, i.e., a time period required to move the developer T through the area B in FIG. 1 is assigned TB. As a matter of course, TA and TB are parameters which are determined based on the peripheral speeds of the upstream and downstream developing sleeves 8 and 11, the magnetic force distribution and dispositions of the magnet rollers 8*a* and 11*a* within the upstream and downstream developing sleeves 8 and 11, the peripheral speed of the photosensitive drum 10, and the like.

Note that, it is supposed that the first developing portion X1 which becomes a starting point when TA and TB are defined herein is the closest position between the upstream developing sleeve 8 and the photosensitive drum 10. In addition, it is supposed that the second developing portion X2 is the closest position between the downstream developing sleeve 11 and the photosensitive drum 10.

Note that, for example, the following method can be used as the method of measuring the time period TA. Thus, there may be measured a time period from a time point when the toner having a color different from that of the toner which is already borne is stuck onto the upstream developing sleeve 8 to a time point when that toner is delivered to the downstream developing sleeve 11 after having passed through the first developing portion X1 to reach the second developing portion X2.

Here, if a difference between the time period TA required to feed the developer from the upstream developing sleeve 8 to the downstream developing sleeve 11 and the time period TB required to feed the developer through the area B on the photosensitive drum 10 is obtained, and a ratio S of the difference to the interval 2π/V1 at which the screw pitch-like density unevenness D is repeatedly formed on the upstream developing sleeve 8 is obtained, it is possible to grasp a degree of the phase shift between the developer on the upstream and downstream developing sleeves 8 and 11 and the developer on the photosensitive drum 10. The ratio S is expressed by Equation (5):

$$S=(|TA-TB|)/(2\pi/V1) \quad (5)$$

Here, there was verified the level of the screw pitch-like density unevenness D in the solid image which was formed on the recording material 27 while the ratio S (the phase shift between the developer on the upstream and downstream developing sleeves 8 and 11 and the developer on the photosensitive drum 10) was actually changed under the various conditions. TABLE 1 shows the verification results. In this examination, spiral screws as shown in FIG. 5 were used as the first and second conveying screws 5 and 6, and agitating screws each having a spiral interval of about 15 mm were used. Note that the evaluation for the level of the screw pitch-like density unevenness D in TABLE 1 is expressed as follows:

xx: unevenness is largely conspicuous, x: unevenness can be observed,

Δx: unevenness can be observed weakly,

Δ: unevenness can be observed, but is inconspicuous, and o: no unevenness can be observed.

TABLE 1

| S | Screw pitch-like density unevenness level | In-plane density difference |
|---|---|---|
| 0 | xx | 0.150 |
| 0.1 | xx | 0.120 |
| 0.15 | x | 0.100 |
| 0.2 | Δx | 0.050 |
| 0.25 | Δ | 0.040 |
| 0.3 | o | 0.030 |
| 0.5 | o | 0.015 |
| 0.7 | o | 0.020 |
| 0.75 | Δ | 0.020 |
| 0.8 | Δx | 0.045 |
| 0.85 | x | 0.090 |
| 0.9 | xx | 0.120 |
| 1 | xx | 0.120 |

Hereupon, it was found out that when the ratio S is in a range of 0.25 to 0.75, the in-plane density difference is equal to or smaller than 0.05, and thus the screw pitch-like density unevenness can also be suppressed to the practically inspicuous level even in the case of the solid image.

In the setting of the developing apparatus in this examination, when the density unevenness appeared, the screw pitch-like density unevenness with a width of a little larger than 3 mm appeared at intervals of 15 mm. Here, when the ratio S is allowed to the range of 0.25 to 0.75, a situation is provided in which the density unevenness with a width of 3 mm is formed with a position at 0 mm in the intervals of 15 mm as a center in the upstream developing sleeve 8, and the density unevenness with a width of 3 mm is developed with a position at about 4 mm as a center in the downstream developing sleeve 11. Thus, the respective density heterogeneities are not superposed on each other, and the density unevenness level also becomes inspicuous on the image.

On the other hand, if the ratio S is allowed to the range of equal to or smaller than 0.2, the density heterogeneities with widths are superposed on each other, and thus the screw pitch-like density unevenness appears.

Note that the actual density heterogeneities (dark and light patterns) on the upstream and downstream developing sleeves 8 and 11 and the photosensitive drum 10 were observed with an optical sensor for distribution (dark and light pattern) of a bearing amount of toner under the conditions in which a developing bias voltage was applied only to one of the upstream and downstream developing sleeves 8 and 11, and the development was carried out only by one side developing sleeve.

In addition, when the correspondence to the density on paper is obtained, there is a difference of equal to or larger than 0.03 mg/cm$^2$ in a bearing amount of toner on the photosensitive drum 10 in the axial direction thereof. Thus, if the concave portions (light portions) generated through the development by the upstream developing sleeve 8 and the concave portions (light portions) generated through the development by the downstream developing sleeve 11 are superposed in phase on each other, the density unevenness on the paper becomes equal to or larger than 0.1 and thus is conspicuous.

However, in a case where the phase is shifted so as to obtain the above range, even if a bearing amount of toner on the photosensitive drum 10 in the axial direction thereof has a difference of 0.035 mg/cm$^2$, it is possible to guarantee that the convex portions (dark portions) obtained through the development by the downstream developing sleeve 11 are superposed on the concave portions (light portions) obtained through the development by the upstream developing sleeve 8, the density difference on the recording material 27 becomes equal to or smaller than 0.04. The distribution (a maximum baring amount of toner—a minimum bearing amount of toner) of a bearing amount of toner on the photosensitive drum 10 after completion of the development by the downstream developing sleeve 11 when the density difference on the recording material 27 became 0.04 was in a range of about 0.01 to about 0.005 mg/cm$^2$.

Consequently, it was found out that if the distribution (dark and light pattern) of a bearing amount of toner on the photosensitive drum 10 is suppressed to equal to or smaller than 0.01 mg/cm$^2$, the density unevenness is prevented from being conspicuous on the solid image or the like.

In addition, the time period required to feed the screw pitch-like density unevenness D from the upstream developing sleeve 8 to the downstream developing sleeve 11, and the time period required to feed the screw pitch-like density unevenness D through the area B on the photosensitive drum 10 in the experiments were measured using a combination of a high-speed camera, FASTCAM 120KC (manufactured by PHOTORN LIMITED), and an industrial borescope and an industrial fiberscope (manufactured by OLYMPUS CORPORATION).

From the foregoing, when the angular velocity V1 of the first conveying screw 5 for agitating and supplying the developer to the upstream developing sleeve 8, the time period TB required to feed the developer from the first developing portion X1 to the second developing portion X2 through the area B on the photosensitive drum 10, and the time period TA required to feed the developer from the upstream developing sleeve 8 to the downstream developing sleeve 11 through the path A are set so as to satisfy Equation (6), it is possible to dissolve the screw pitch-like density unevenness which was a problem:

$$N+0.25<(|TA-TB|)/(2\pi/V1)<N+0.75 \quad (6)$$

where N represents an integral number equal to or larger than 0.

In addition, Embodiment 1 adopts the construction in which the developer is delivered from one developing sleeve to the other developing sleeve by utilizing the magnetic forces of the magnets provided inside both the developing sleeves. This construction offers an effect in which since the developer can be utilized with a minimum load applied to the developer while the developer is agitated and conveyed within the developing apparatus, a life of the developer is lengthened. Consequently, an image which has high image quality and which is free from the density unevenness in the solid image or the like can be provided for a long term.

In addition, Embodiment 1 adopts the construction in which the magnetic poles having the different polarities (the first magnetic pole N3 of the upstream developing sleeve 8 and the third magnetic pole S3 of the downstream developing sleeve 11 in FIG. 1) of the magnetic poles of the magnets in the delivering portion between the developing sleeves are made close to each other. However, even when a construction is adopted in which the magnetic poles having the same polarity are made close to each other, the effects and operation of the present invention can be similarly obtained. In addition, even when the construction having the delivering portion as shown in FIG. 1 is not adopted, the same effects can be obtained as long as the dark and light in phase of the density unevenness on the photosensitive drum generated through the development on the upstream side and the dark and light in phase of the density unevenness formed on the downstream developing sleeve are prevented from being superposed on each other.

Embodiment 2

Next, a developing apparatus 100 according to Embodiment 2 of the present invention shown in FIG. 1 will be described. Embodiment 2 aims at lengthening a life of the developer in addition to the offering of the effects of Embodiment 2.

As described in the conventional examples, the degradation of the developer is caused through the friction caused in the developer in the developer layer thickness regulating portion. In Embodiment 2, in order to prevent the developer from being degraded in the developer layer thickness regulating portion, the disposition of the regulating blade 9 in the developing chamber 3 was adjusted.

That is, in this case, the regulating blade 9 is disposed above the developing chamber 3. More specifically, the regulating blade 9 was disposed so that the closest point was located at a distance of 400 μm from the upstream developing sleeve 8 and was located on the downstream side with respect to the second magnetic pole N1 on the downstream side of the second magnetic pole N1 and the first magnetic pole N3 as the repulsive magnetic poles of the inner magnet 8*a* in the rotation direction of the upstream developing sleeve 8 by an angle of rotation of 5°. Then, a distance (distance SB) between the upstream developing sleeve 8 and the regulating blade 9 is determined so as to be optimized based on the magnetic force of the second magnetic pole N1 and a coating amount of developer (about 30 mg/cm$^2$ in Embodiment 2) on the upstream developing sleeve 8.

The regulating blade 9 in Embodiment 2 includes a blade made of a nonmagnetic material and magnetic plates made of magnetic materials each of which has a thickness of 0.3 mm and which are bonded to side faces of the blade, respectively.

Thus, as described above, the construction is adopted in which one magnetic pole forming the repulsive magnetic field is disposed in the vicinity of the developer layer thickness regulating portion, whereby the degradation of the developer is reduced since a collection amount of developer collected in the developer layer thickness regulating portion reduces and a load applied to the developer is light.

Moreover, as described above, the magnetization of the carrier in the developer is reduced, i.e., the magnetization of the carrier is reduced to weaken the force for rubbing the toner image formed on the photosensitive drum 10 through the development in the developing portions to realize the high image quality promotion. As a result, the degradation of the developer can also be reduced since a collection amount of developer collected in the developer layer thickness regulating portion becomes less.

However, the use of the carrier having the low magnetization and the disposition of the magnetic poles result in that a collection amount of developer collected in the developer layer thickness regulating portion in the regulating blade reduces, and hence the density unevenness in an amount of developer conveyed onto the developing sleeve (the coating unevenness on the developing sleeve) becomes apt to generate. In addition, the use of the carrier having the low magnetization results in that an amount of so-called following developer which cannot be peeled off by the repulsive magnetic field increases, and hence the unevenness is apt to generate in the density of the toner on the developing sleeve.

For this reason, a possibility that the screw pitch-like density unevenness is generated is high.

The use of the carrier having the low magnetization with which a possibility of generation of the unevenness in an amount of developer conveyed to the developing sleeve becomes high, and the adoption of the construction of the developing device having a light load applied thereto as described above are essential to the lengthening of the developer life.

Then, similarly to Embodiment 1, if the angular velocity V1 of the first conveying screw 5 for agitating and supplying the developer to the upstream developing sleeve 8, the time period TA required to feed the developer from the first developing portion X1 of the upstream developing sleeve 8 to the second developing portion X2 of the downstream developing sleeve 11 through the path A on the upstream and downstream developing sleeves 8 and 11, and the time period TB required to feed the developer from the first developing portion X1 of the upstream developing sleeve 8 to the second developing portion X2 of the downstream developing sleeve 11 through the area B on the photosensitive drum 10 are set so as to fulfill the relationship of $N+0.25<(|TA-TB|)/(2\pi/V1)<N+0.75$ (N: an integral number equal to or larger than 0) expressed in Equation (6), the lengthening of the developer life and the dissolving of the screw pitch-like density unevenness can be compatible with each other.

The developing apparatus having the low magnetization carrier and light load construction is used efficiently in accordance with the present invention, whereby images each of which is free from the screw pitch-like density unevenness and has the high in-plane density uniformity can be stably formed for a long term.

Figure 8:
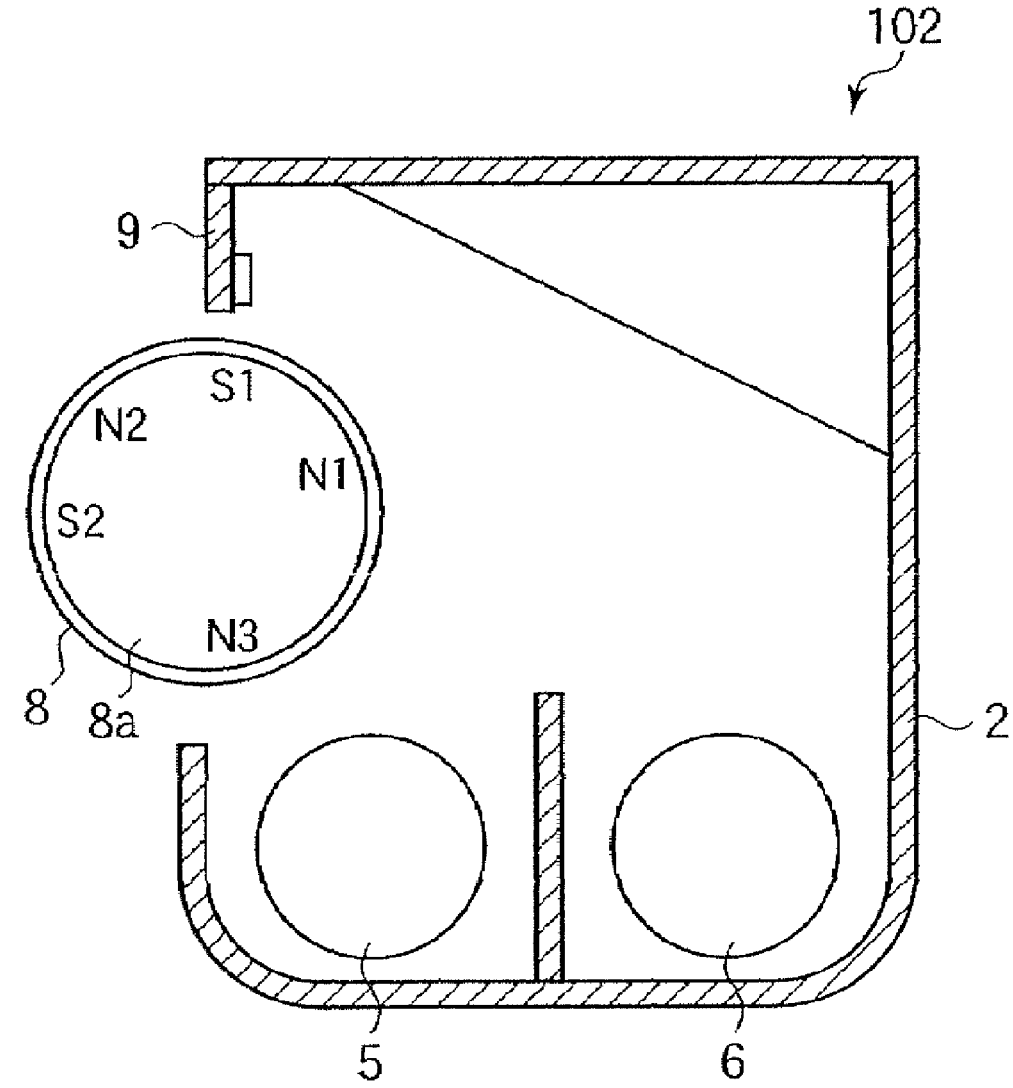
FIG. 8 is a cross-sectional view showing an example of a conventional developing apparatus.
Figure 9:
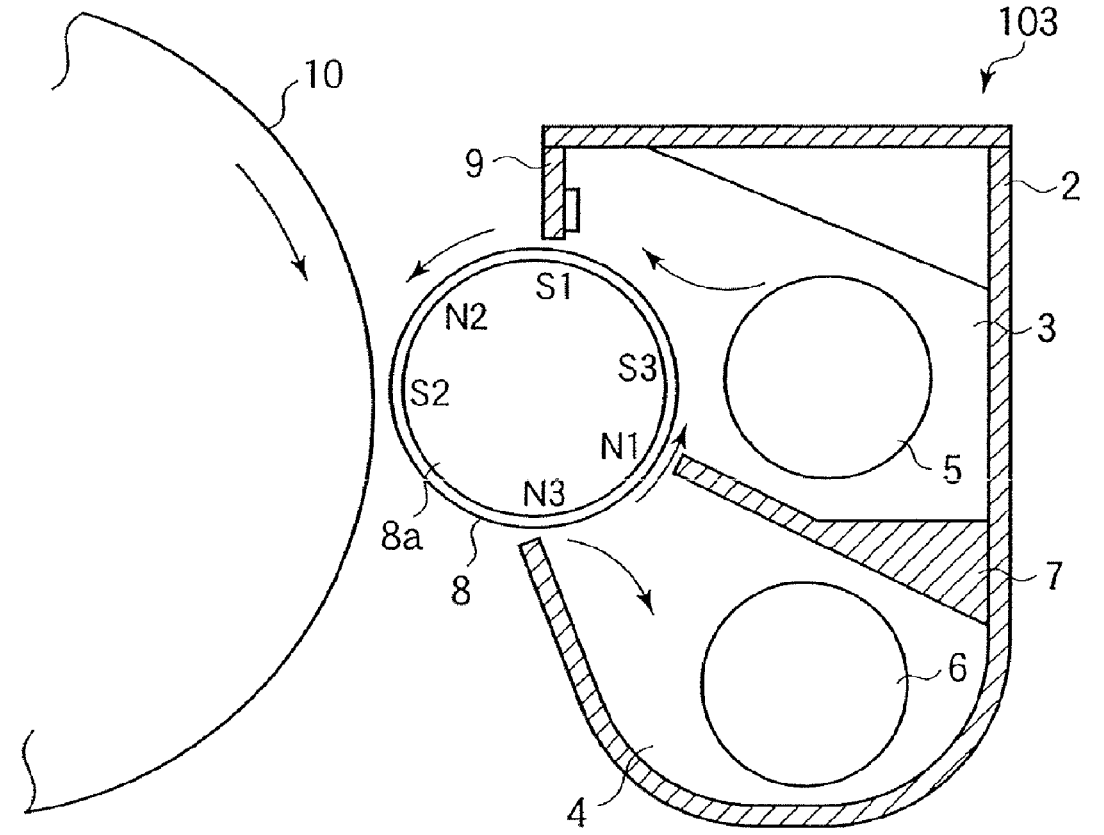
FIG. 9 is a cross-sectional view showing another example of a conventional developing apparatus.

In addition, the construction in which the developer container 2 is partitioned into the developing chamber 3 and the agitating chamber 4 as the feature of the developing apparatus of the present invention is generally adopted for the two-component developing apparatus. However, the developer is not limited only to the two-component developer, and hence the present invention can also be applied to even a developing apparatus using a one-component developer which contains the toner, but contains no carrier. In addition, the construction of the developing apparatus is not limited to that shown in FIG. 1. Thus, for example, the present invention can also be applied to a developing apparatus having a construction in which agitating members are horizontally disposed as shown in FIG. 8 as described in the conventional examples as long as the developing apparatus includes a plurality of developer carrying members.

In addition, while the description has been given with respect to only the case where the number of developer carrying members is two, the present invention is also applied to a developing apparatus including three or more developer carrying members as long as the developing apparatus includes bearing members within a developer container and is provided with two or more developer carrying members opposed to each other since the problem of generation of the screw pitch-like density unevenness in the solid image may arise. Also, when three or more developer carrying members opposed to each other are disposed in a line, the screw pitch-like density unevenness is similarly moved from the most upstream developer carrying member to the downstream developer carrying member along a movement direction of surfaces of the image bearing members. Hence, the setting is carried out so as to change the phase of the screw pitch-like density unevenness moved from the upstream developing bearing members at least in the most downstream developing bearing member.

Figure 10:
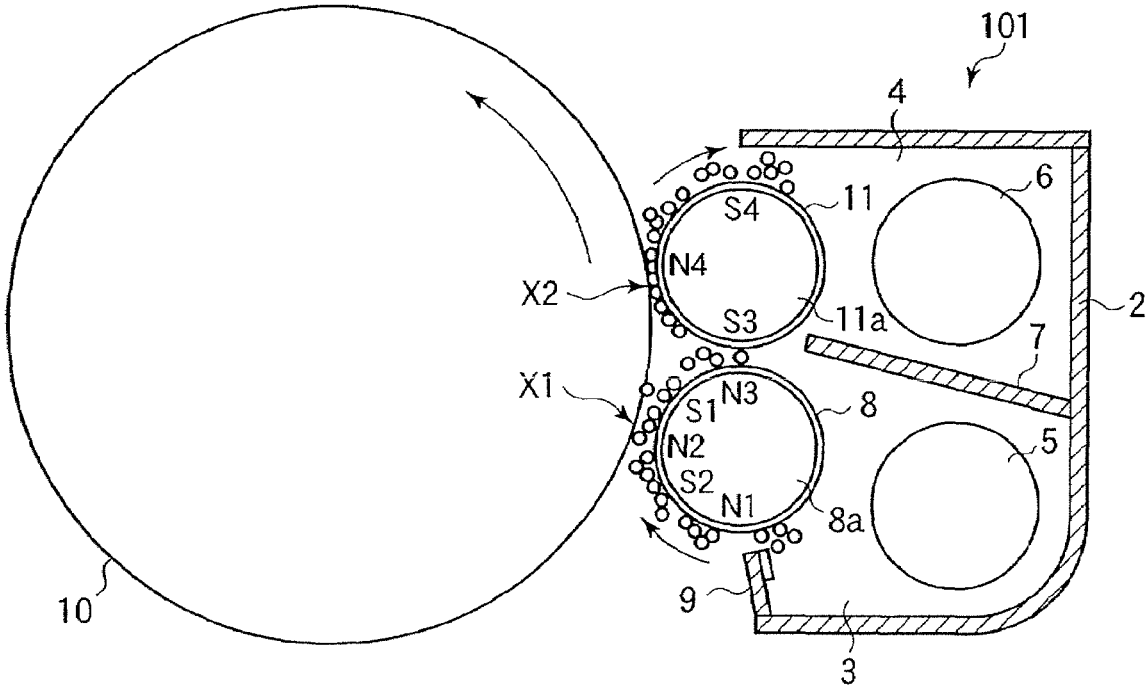
FIG. 10 is a cross-sectional view showing still another example of a conventional developing apparatus.

In addition, the present invention can also be applied to the developing apparatus having the construction as shown in FIG. 10 in which the developing chamber 3 is installed on the lower side in the gravity direction, the developer pressure of the developer supplied to the developer carrying member 8 is reduced, and thus in spite of a little amount of developer, the developer can be suitably supplied to the developer carrying member 8.

In addition, the present invention can be applied not only to the image forming apparatus having the construction shown in FIG. 4, but also an image forming apparatus using the electrostatic recording system, a monochrome image forming apparatus, or an image forming apparatus having an increased number of colors. The present invention can also be applied to an image forming apparatus using an intermediate transfer system, or an image forming apparatus which adopts no tandem system and which-does not have a plurality of photosensitive drums.

The scope of the present invention is not intended to be limited only to the sizes, the qualities of materials, the shapes, the relative positions, and the like of the constituent components or parts of the image forming apparatus described above unless a specific description is especially given.

This application claims priority from Japanese Patent Application No. 2004-128329 filed Apr. 23, 2004, which is hereby incorporated by reference herein.

What is claimed is:

1. An image forming apparatus, comprising:

an image bearing member for bearing and conveying an electrostatic image;

a first developer carrying member for carrying and conveying a developer toward a first developing position; and a second developer carrying member for carrying and conveying the developer toward a second developing position, the second developing position is disposed at a downstream side with respect to the first developing position in a movement direction of the image bearing member, the second developer carrying member receiving the developer carried and conveyed by the first developer carrying member in a developer delivering portion, and thereafter carrying and conveying the developer toward the second developing position, wherein when a time period required for a movement of the developer carried and conveyed by the first developer carrying member and the second developer carrying member from the first developing position through the developer delivering portion to the second developing position is assigned TA, and a time period required for a movement of the developer on the image bearing member from the first developing position to the second developing position is assigned TB, and wherein respective driving speeds of the image bearing member, the first developer carrying member, and the second developer carrying member are controlled so that TA and TB are different values.

2. An image forming apparatus according to claim 1, further comprising:

a conveying member provided within a developer container having the first developer carrying member disposed therein, the conveying member serving to convey the developer in a direction of a rotation axis of the first developer carrying member through its rotational operation, wherein when an angular velocity of the conveying member is assigned V1, a following relationship is satisfied:

$$N30\ 0.25<(|TA-TB|)/(2\pi/V1)<N+0.75$$

where N is an integral number equal to or larger than 0.

3. An image forming apparatus according to claim 1, further comprising:

a first magnetic force generating member disposed within the first developer carrying member; and a second magnetic force generating member disposed within the second developer carrying member, wherein the first magnetic force generating member includes a first magnetic pole in a position opposed to the second developer carrying member, the second magnetic force generating member includes a second magnetic pole in a position opposed to the first developer carrying member, and the first magnetic pole and the second magnetic pole are different in polarity from each other.

4. An image forming apparatus according to claim 3, wherein the first magnetic force generating member includes a third magnetic pole for forming a repulsive magnetic field in cooperation with the first magnetic pole, the third magnetic pole is disposed on a downstream side with respect to the first magnetic pole in a rotation direction of the first developer carrying member.

* * * * *

UNITED STATES PATENT AND TRADEMARK OFFICE

CERTIFICATE OF CORRECTION

PATENT NO. : 7,236,727 B2
APPLICATION NO. : 11/107735
DATED : June 26, 2007
INVENTOR(S) : Tadashi Fukuda It is certified that error appears in the above-identified patent and that said Letters Patent is hereby corrected as shown below:

COLUMN 1

Line 15, “troststatic” should read --trostatic--.

COLUMN 3

Line 7, “living” should read --life--;
Line 12, “spent)” should read --spent).--;
Line 18, “9 for example” should read --9, for example--;
Line 24, “rotation” should read --rotational--.

COLUMN 4

Line 8, “especially, a black solid image” should read --especially a black solid image,--;
Line 45, “rotation” should read --rotational--;
Line 48, “rotation” should read --rotational--;
Line 62, “years, there” should read --years there--;
Line 64, “images, such” should read --images such--;
Line 65, “duty,” should read --duty--.

COLUMN 7

Line 41, “nonmagnetic” should read --non-magnetic--;
Line 56, “rotation” should read --rotational--;
Line 61, “rotation” should read --rotational--.

COLUMN 8

Line 16, “cross sectional” should read --cross-sectional--;
Line 39, “nonmagnetic” should read --non-magnetic--;
Line 46, “N1 having the same polarity” should read --N1, having the same polarity,--;
Line 56, “descried” should read --described--.

COLUMN 10

Line 1, “to be made contribute” should read --to contribute--;
Line 7, “rotation” should read --rotational--;
Line 19, “high duty” should read --high density--;
Line 22, “thus” should read --and thus--;
Line 33, “Upstream” should read --upstream--.

COLUMN 11

Line 4, “profiles each” should read --profiles, each--.

UNITED STATES PATENT AND TRADEMARK OFFICE

CERTIFICATE OF CORRECTION

PATENT NO. : 7,236,727 B2
APPLICATION NO. : 11/107735
DATED : June 26, 2007
INVENTOR(S) : Tadashi Fukuda It is certified that error appears in the above-identified patent and that said Letters Patent is hereby corrected as shown below:

COLUMN 13
Line 21, “Note that, it” should read --Note that it--.

COLUMN 14
Line 29, “to the range” should read --from the range--;

COLUMN 15
Line 6, “baring” should read --bearing--.

COLUMN 16
Line 27, “rotation” should read --rotational--.

COLUMN 17
Line 21, “the area” should read --area--.

Signed and Sealed this

Twenty-fifth Day of March, 2008

JON W. DUDAS
*Director of the United States Patent and Trademark Office*